United States Patent [19]

Haglund et al.

[11] Patent Number: 4,712,478

[45] Date of Patent: Dec. 15, 1987

[54] ALIGN AT FIRE, SAFE AND ARM, AND POWER SUPPLY MODULE FOR A LAND MINE

[75] Inventors: Steve A. Haglund, Minnetonka; Arthur M. Lohmann, Hopkins; Sharon A. Pickering-Johnson, St. Louis Park, all of Minn.

[73] Assignee: Honeywell Inc., Minneapolis, Minn.

[21] Appl. No.: 4,937

[22] Filed: Jan. 20, 1987

[51] Int. Cl.[4] ..... F42B 23/24

[52] U.S. Cl. ..... 102/424; 102/401

[58] Field of Search ..... 102/401, 404, 424, 426, 102/427

[56] References Cited

U.S. PATENT DOCUMENTS 4,292,861 10/1981 Thornhill, Jr. et al. ..... 102/401

FOREIGN PATENT DOCUMENTS 3127522 1/1983 Fed. Rep. of Germany ..... 102/401
3151674 7/1983 Fed. Rep. of Germany ..... 102/426
8603827 7/1986 PCT Int'l Appl. ..... 102/401
12797 12/1914 United Kingdom ..... 102/404

*Primary Examiner*—Charles T. Jordan

*Attorney, Agent, or Firm*—Roger W. Jensen

[57] ABSTRACT

An align at fire safe and arm and electrical power supply module 10 for an electronically fuzed land mine 12. The module 10 is removably mounted into the land mine 12. Reserve batteries 16 are contained in the module 10 and are energized when a safety pin 25 is removed during mine emplacement. A slider 30 is located in the module housing 14. When the slider 30 is in its safe position, the firing train 57 of the warhead 65 of the mine 12 is interrupted. When the slider 30 is driven into its armed position by a piston actuator 32 in response to an align signal being produced by the fuzing subsystem 87 of the mine 12, the firing train 57 is completed through a transfer lead 60 located in the slider 30. The firing train detonator 44 may then be functioned by an electrical firing signal produced by the fuzing subsystem which will event the warhead 65. Detonating the firing train detonator 44 before the slider 30 is driven into its armed position, self-neutralizes the mine 12. A visual safe indicator 18 slaved off the detonation of the firing train detonator 44 produces a highly visible indicator 84 which aids in locating a self-neutralized mine 12 and to signal that the mine 12 is safe to approach and recover.

19 Claims, 13 Drawing Figures

ALIGN AT FIRE, SAFE AND ARM, AND POWER SUPPLY MODULE FOR A LAND MINE

CROSS REFERENCE TO RELATED APPLICATIONS

The following application, Ser. No. 008,237, filed Jan, 29, 1987 is incorporated by reference into this application: "Firing Train Function Indicator" by W. Keith Gallant, which application is filed concurrently with this application and is assigned to the same assignee as this application.

IBACKGROUND OF THE INVENTION

1. Field of the Invention

This invention is in the field of recoverable land mines, and more particularly relates to an align at fire, safe and arm, and power supply (AFSAP) module with a visual safe indicator for an electronically fuzed recoverable land mine.

2. Description of the Related Art

A munition, such as a land mine, particularly one provided with an electronic target sensor or sensors as a component of its fuzing subsystem, is designed to self-destruct after the passage of a predetermined period of time, or when it reaches the end of its useful life. In such a mine, the explosive train of the safing and arming subsystem is moved in line, or the mine is armed, well in advance of detonation, or eventing, the mine's warhead. Therefore, such a mine is not safely recoverable once it has been initiated, or armed.

To minimize cost and to conserve material it is desirable that an electronically fuzed land mine not self-destruct at the end of its useful life or upon the occurrence of some other predetermined event, such as the passage of a given period of time, but rather self-neutralize so that it is safe to recover and refurbish. It is also desirable that the personnel who recover self-neutralized mines be confident that such mines are safe to recover. The probability of successfully recovering a self-neutralized mine increases if the self-neutralized mine displays a highly visible device to help locate it as well as to provide visual evidence that a mine displaying such a highly visible device is safe to recover.

SUMMARY OF THE INVENTION

The present invention provides an electronically fuzed recoverable land mine with a replaceable align at fire, safe and arm, and power supply (AFSAP) module. The housing of the AFSAP module is provided with a fitting so that the module can be removably secured into the body of a land mine in cooperation with a fitting in the mine. The mine into which the AFSAP module is mounted includes an appropriate explosive charge, or warhead, and an electrically powered fuzing subsystem which includes sensors for detecting the presence of personnel or vehicles for example, and for producing the necessary control signals to detonate the warhead when a target is within destructive range.

A slider is located within the housing of the AFSAP module. The slider has two positions, a safe position and an armed position. An electrically initiated piston actuator is provided to drive the slider from its safe position to its armed position. When the slider is in its armed position, the firing train is aligned and extends from an electrically fired detonator located in the module housing, through a transfer lead retained, or located in the slider to an output lead which communicates with the input lead of the warhead. The detonator is initiated by a firing signal produced by the mine's electrical fuzing subsystem. If the slider is in its armed position, or the firing train is aligned, initiating the detonator will event the mines warhead. A few milliseconds of delay is all that is required between aligning the firing train and eventing the mine.

When the slider is in its safe position, the detonator, transfer lead, and the output lead are not in communication with one another, or they are not aligned. Hence the firing train is interrupted. If the detonator is initiated, or fired, by a fire signal, while the firing train is interrupted, the warhead of the mine is not set off, or evented, and the mine is self-neutralized and the firing train is permanently aborted. A visual safe indicator is mounted on the AFSAP module housing and is in communication with the detonator so that when the detonator events while the firing train is interrupted, the indicator is displayed signifying that the firing train is permanently aborted, or the mine has self-neutralized. Thus, a land mine whose visual safe indicator is displayed, is safe to recover. The visual safe indicator also makes a self-neutralized mines readily visible so that the chance of a self-neutralized mine being overlooked when the mines of a mine field are to be recovered is significantly reduced.

The AFSAP module of this invention also includes reserve batteries along with the necessary electrical conductors and connectors so that electrical power from the reserver batteries can be supplied to the mine fuzing subsystem when the batteries are activated. These conductors and connectors electrically connect the fuzing subsystem to the piston actuator and the electrical detonator of the AFSAP module so that align and fire signals when produced by the fuzing subsystem can be applied.

A safety pin is provided to restrain the slider in its safe position. Removal of the safety pin, which is done only when a mine is emplaced, energizes the reserve batteries in addition to permitting the piston actuator to drive the slider from its safe position to its armed position. A safing boss restrains the slider from moving into its armed position until the piston actuator is fired by an align signal. The safing boss is sheared off when the piston actuator drives the slider into its armed position.

After a mine has self-neutralized and is recovered, its warhead and fuzing subsystems can be refurbished to the extent necessary or desirable. The mine is then reassembled by mounting a new AFSAP module into the cooperating fitting of the mine which also makes the necessary electrical and pyrotechnic connections between the mine and the module.

It is therefore an object of this invention to provide a replaceable safe and arm and power supply module or a recoverable, electronically fuzed land mine.

It is another object of this invention to provide an AFSAP module for a mine which aligns, or arms, the firing train immediately prior to the mine eventing so that at any time prior to the mine being armed, the safe and arm subsystem, upon the occurrence of predetermined conditions, can self-neutralize the mine to allow its safe recovery.

It is another object of this invention to provide a safe and arm and power supply module for a land mine which displays a visual safe indicator when the mine has self-neutralized and thus, a visual signal that the mine is safe to recover.

It is another object of this invention to provide a safe and arm and power supply module for a land mine which permanently interrupts, or aborts, the firing train to self-neutralize the mine to provide for the safe recovery of the mine.

It is still another object of this invention to provide a safe and arm and power supply module for a mine which permits the warhead and fuzing mechanisms of the land mine to be recovered, refurbished, and reused.

BRIEF DESCRIPTION OF THE DRAWINGS

Other objects, features and advantages of the invention will be readily apparent from the following description of the preferred embodiment thereof, taken in conjunction with the accompanying drawings, although variations and modification may be effected without departing from the spirit and scope of the novel concepts of the disclosure, and in which.

DESCRIPTION OF THE PREFERRED EMBODIMENT

Figure 1:
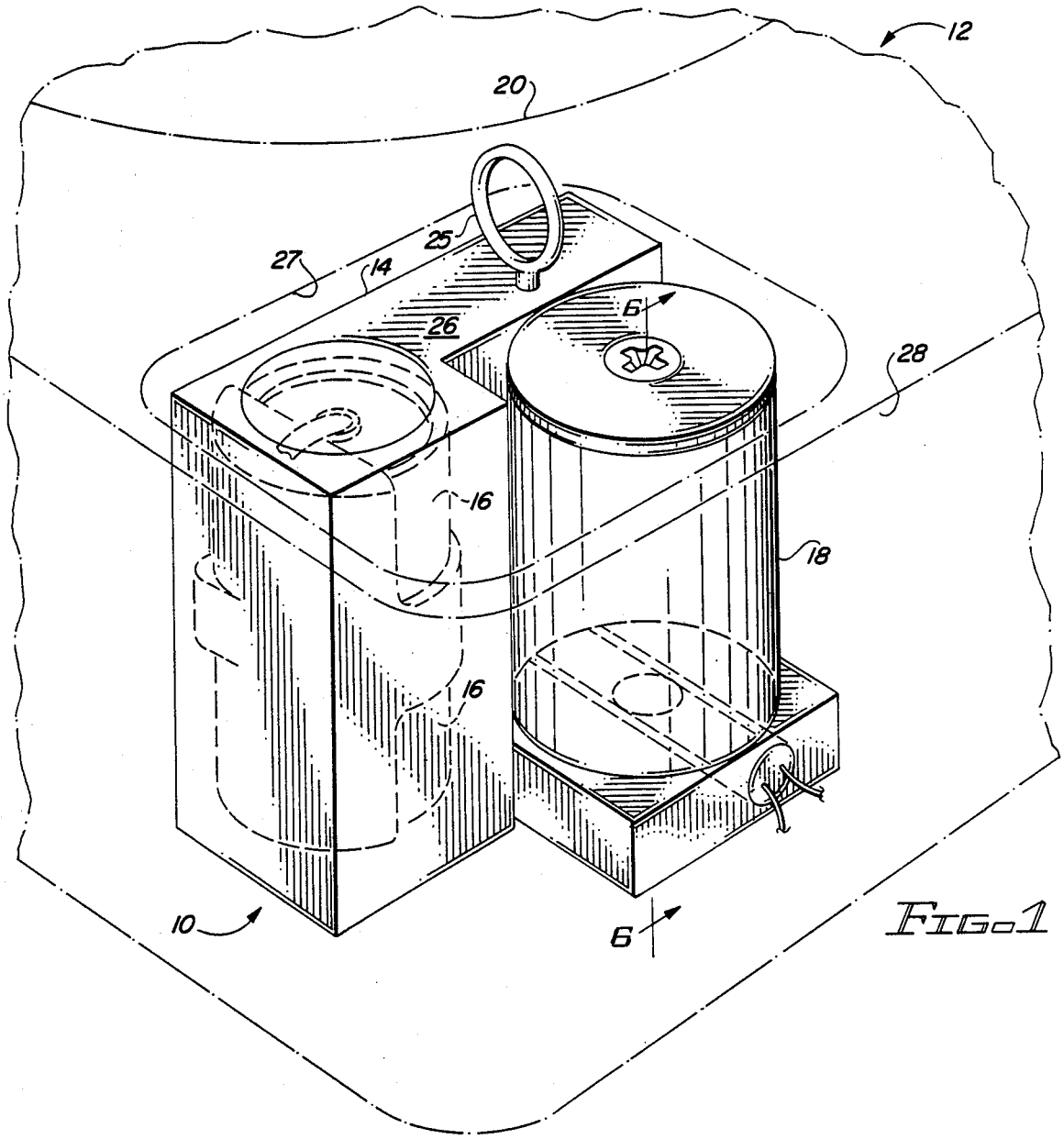
FIG. 1 is a perspective view of a preferred embodiment of the replaceable align at fire, safe and arm, and power supply module for a land mine embodying this invention.

In FIG. 1 AFSAP module 10, is removably mounted into a conventional land mine 12 which is illustrated in broken lines. Module 10 includes a housing 14 in which is contained reserve batteries 16 and on which is mounted a visual safe indicator 18. Module 10 is removably secured to the housing 20 of mine 12 by cooperating dovetail fittings 22, 24 as is best seen in FIGS. 3A–D. Safety pin 25 projects through the upper surface 26 of housing 14. Module 10 when mounted into mine 12 fits between side wall 27 and outer wall 28 of mine 12.

Figure 2:
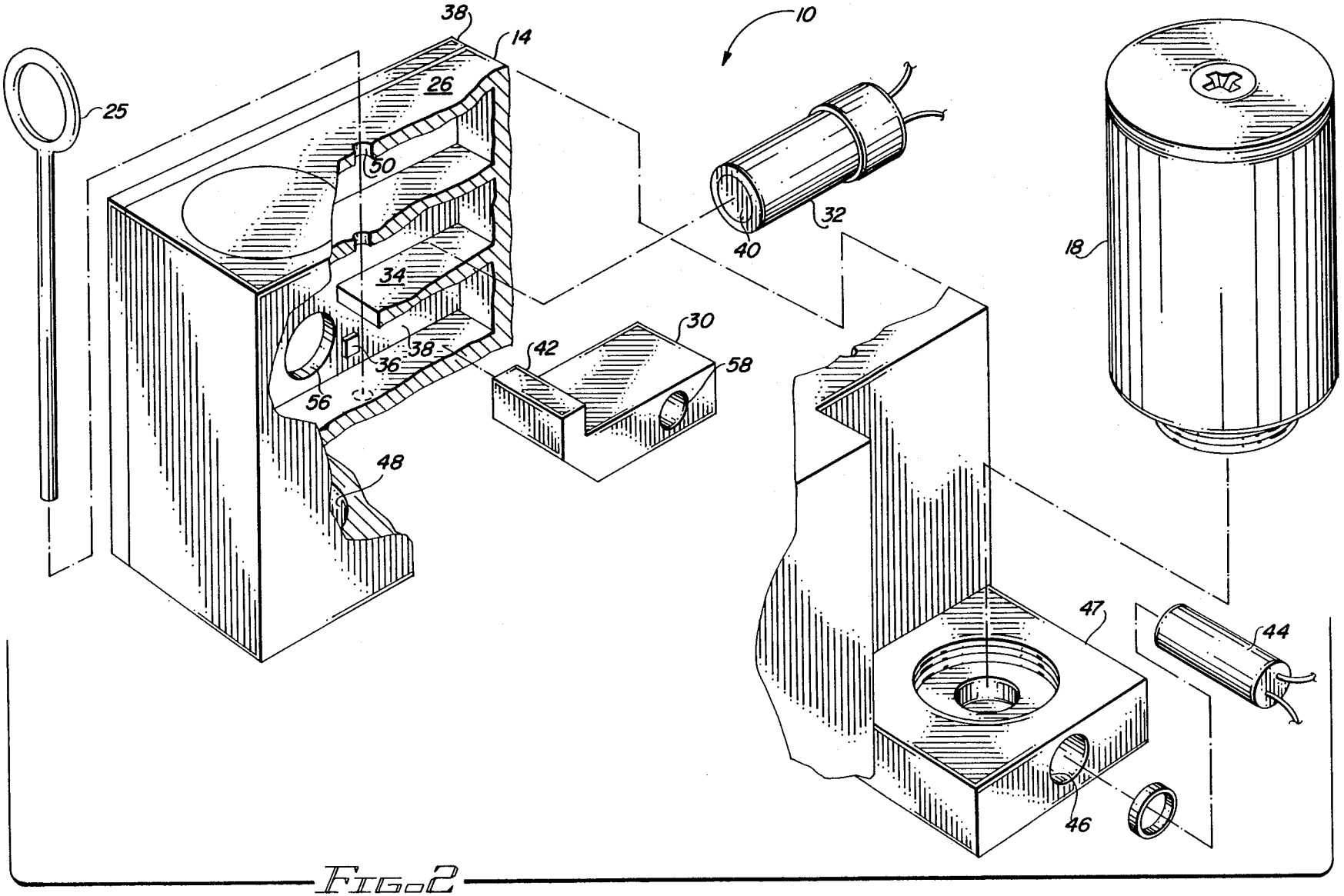
FIG. 2 is an exploded view of the AFSAP module illustrated in FIG. 1.

In FIG. 2, housing 14 is broken apart so the details of slider 30 and piston actuator 32 are illustrated as well as the interior of housing 14. Slider 30 fits into the lower portion of housing 14 below dividing partition 34. Slider 30 is provided with a recess, not seen in FIG. 2, into which safety boss 36 fits. Boss 36 is formed on the inner surface 38 of the slider cavity of housing 14. Piston actuator 32 is positioned in housing 14 above partition 34 with its driver piston 40 in contact with projection 42 of slider 30. Electrically fired detonator 44 fits into an opening 46 in the visual safe indicator support portion 47 of housing 14. Visual safe indicator 18 is mounted onto support portion 47 of housing 14. Reserve batteries 16 are positioned in the battery cavity 48 of housing 14. Safety pin 25 extends through an opening 50 in the upper surface 26 of housing 14.

Figure 3A:
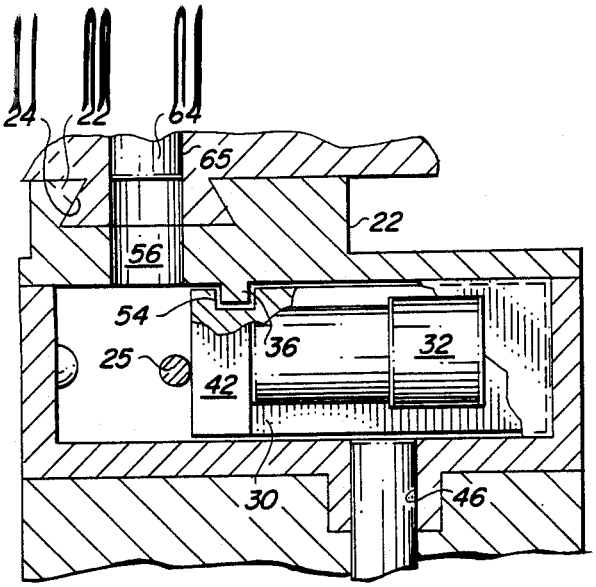
FIGS. 3A–D are diagrammatic representations illustrating the safe and armed positions of the slider of the module.
Figure 3C:
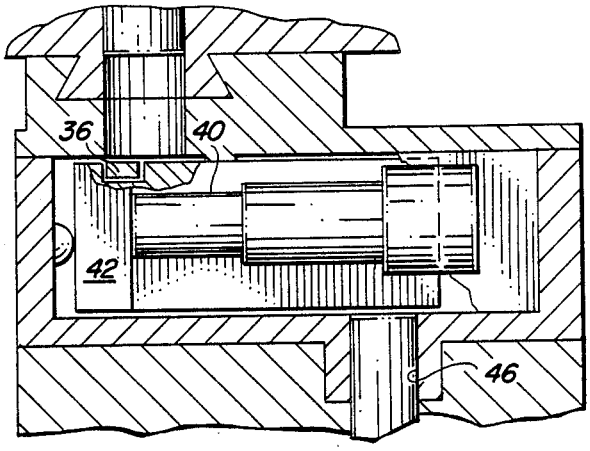
Figure 3B:
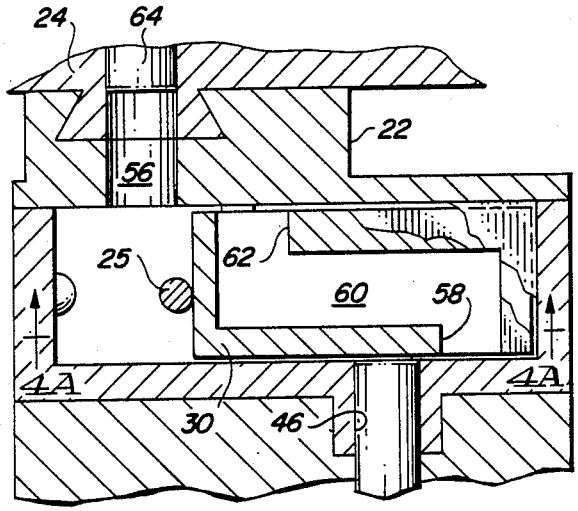

In FIG. 3A and 3B, safety pin 25 is illustrated in place, where it restrains slider 30 and makes certain that slider 30 is and remains in its safe position with piston actuator 32 in contact with projection 42 of slider 30. Safety boss 36 fits into recess 54 of slider 30. The location of output lead 56 through fitting 22 is best illustrated in FIG. 3A–D.

Figure 3D:
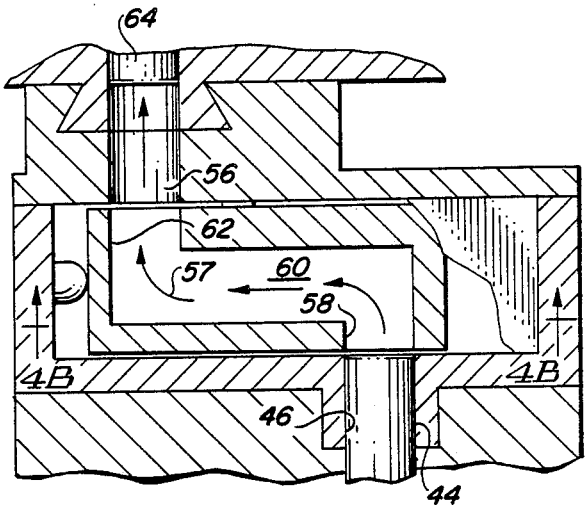
Figure 4A:
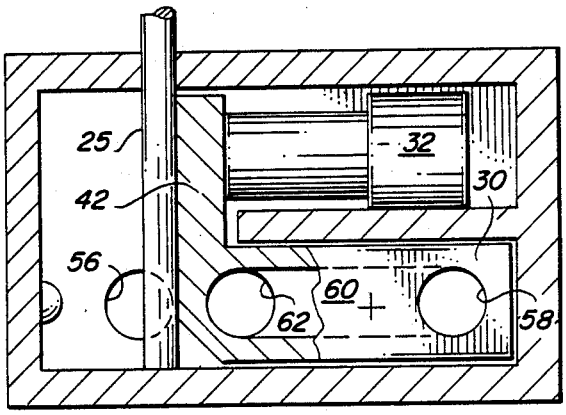
FIGS. 4A and B are diagrammatic representations of one function of the safety pins of the module.
Figure 4B:
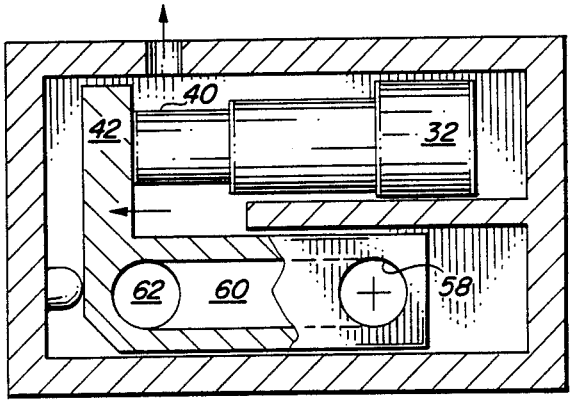

When slider 30 is in its safe position, the firing train 57 is interrupted. As illustrated in FIGS. 3B, inlet opening 58 of transfer lead 60 which is retained in slider 30, is not aligned with opening 46 and detonator 44. The outlet opening 62 of transfer lead 60 is not aligned or in communication with output lead 56. When slider 30 is driven into its armed position, firing train continuity is achieved. As illustrated in FIG. 3D, inlet 58 is then aligned with opening 46 and detonator 44. Outlet 62 is with output lead 56 which in turn is aligned with input lead 64 of the mine warhead 65. When slider 30 is in its armed, or in-line position, as illustrated in FIG. 3D, the firing train 57 which includes detonator 44, transfer lead 60, output lead 56 and warhead input lead 64 is aligned and ready, or armed, awaiting only the initiation, or detonation, of electric detonator 44 to event warhead 65.

Figure 5A:
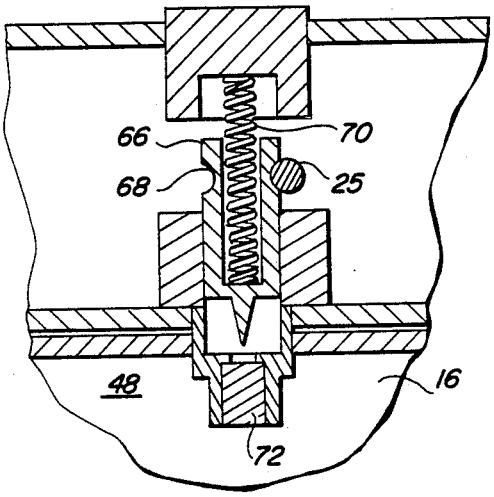
FIGS. 5A and B are diagrammatic representations of the mechanism for energizing the reserve batteries of the module.
Figure 5B:
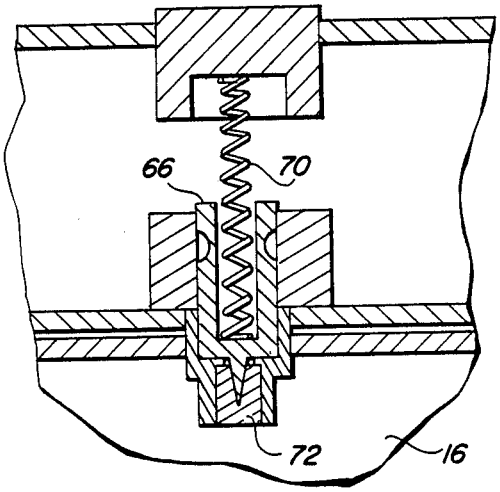

In FIG. 5A a mechanism for activating reserve batteries 16 is illustrated. Firing pin 66 is provided with a circumferential recess 68 within which safety pin 25 fits to retain firing pin 66 in its retracted position as illustrated in FIG. 5A. Compression spring 70 is positioned to drive firing pin 66 into stab primer 72 when safety pin 25 is withdrawn as illustrated in FIG. 5B. Details of suitable reserve batteries 16 and a description as to how the force of the detonation of primer 72 caused by firing pin 66 striking it, is transmitted to and fractures ampoules containing a suitable electrolyte to activate the batteries, is described and claimed in U.S. Pat. No. 4,375,504.

Figure 7:
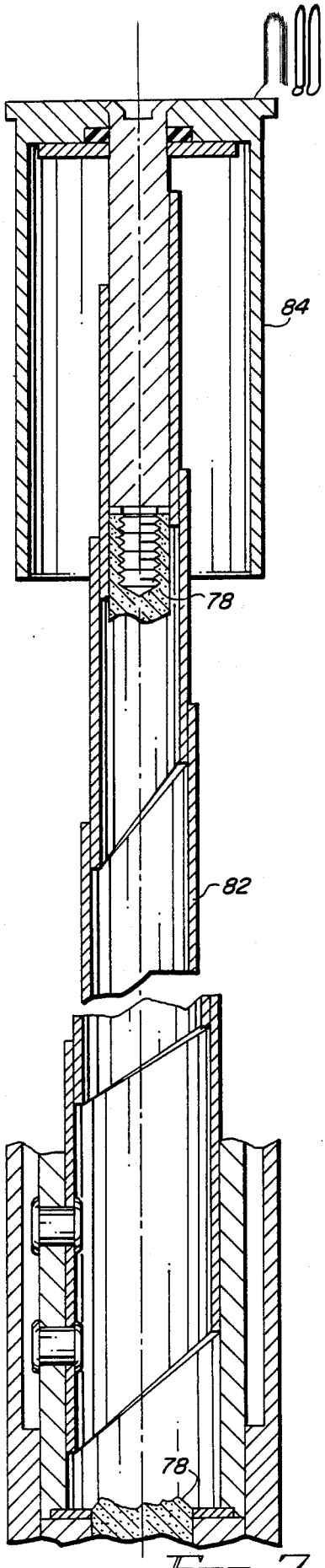
FIG. 7 is a schematic representation of the visual safe indicator when a displayed.
Figure 6:
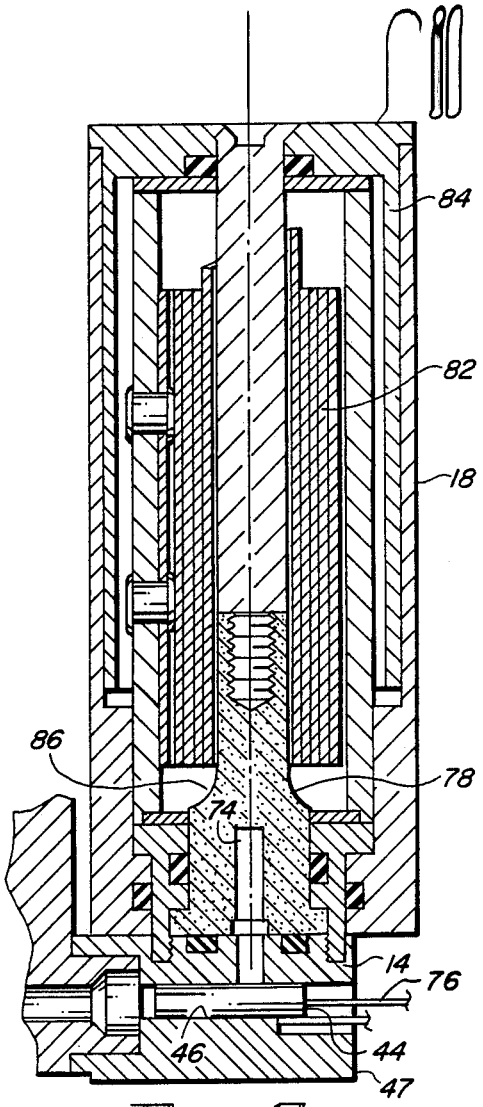
FIG. 6 is a schematic sectional view taken on line 6—6 of FIG. 1 of the visual safe indicator in its initial, or non-display, condition.

In FIG. 6 visual safe indicator 18 is mounted onto the stator support portion 47 of housing 14. Visual safe indicator 18 is provided with a stab sensitive detonator 74. Passage 76 provides communication with detonator 44. Detonator 74 is a component of explosive bolt 78 of the visual safe indicator 18. Cover piece 80 of visual safe indicator 18 is used to hold the helical coil of spring steel 82 in compression, integral with cover piece 80 is flag 84. In the preferred embodiment, flag 84 is colored and coated so that when displayed it is readily visible. When stab primer 74 is detonated by the explosion of detonator 44, bolt 78 shatters along fracture lines determined by stress concentrating contour 86. Helical coil 82 is then free to expand and raises flag 84 so that it is displayed, or visible. Cover piece 80 and flag 84 when displayed as illustrated in FIG. 7 are about one foot above their compressed position as illustrated in FIG. 6. For additional information on the structure and function of visual safe indicator 18, reference is made to the application entitled "Firing Train Function Indicator" further identified in the section of this application entitled "Cross-Reference to Related Applications".

Figure 8:
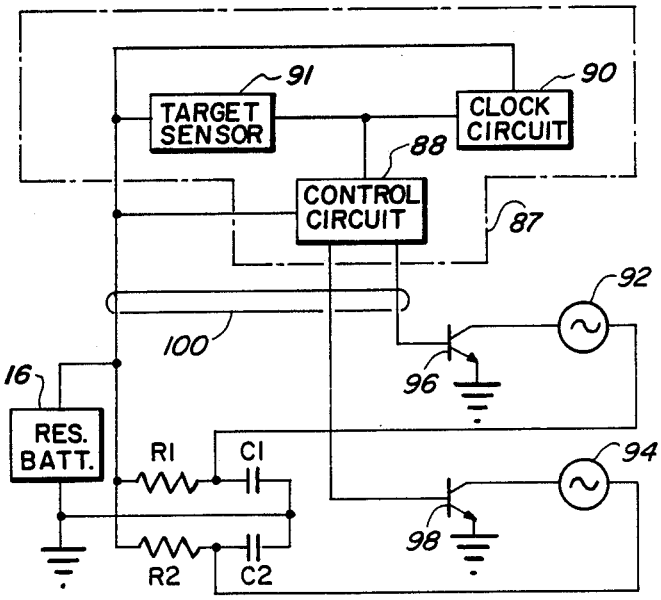
FIG. 8 is a schematic block diagram of the electrical and electronic subsystems of the invention.

In FIG. 8 the major components of the electronic fuzing subsystem 87 of mine 12 are control circuit 88, system timing, or clock, circuit 90, and target sensor 91. Power for fuzing subsystem 87 is provided by reserve batteries 16 when energized. Bridgewires 92, 94 of piston actuator 32 and detonator 44 are connected between capacitors C1 and C2 and the collectors of npn transistors 96, 98 respectively. An alignment, or align, signal, a positive voltage pulse, applied to the base of transistor 96 will cause current to flow from capacitor C1, through bridgewire 92 and, the collector and emitter of transistor 96 to initiate piston actuator 32. Similarly a fire signal, a positive voltage pulse from control electronics 88, will cause current to flow through bridgewire 94, initiating detonator 44. Electrical connections between fuzing subsystem 87 and module 10 are by an appropriate electrical weatherproof connector 100 which is schematically illustrated in FIG. 8.

Operation of module 10 is initiated when safety pin 25 is removed. Removal of safety pin 25 unrestrains slider 30 while also energizing reserve batteries 16 to provide the necessary electrical power to fuzing subsystem 87 and to charge capacitors C1 and C2. When a suitable, or desired, target is sensed by target sensor 91, control electronics 88 of fuzing subsystem 87 produces an align signal which is applied to the base of transistor 96 to allow current to flow from capacitor C1 through bridgewire 92. This then explodes bridgewire 92 of piston actuator 32 to ignite the balance of the explosive charge contained in piston actuator 32. This in turn drives piston 40 against projection 42 of slider 30 and moves slider 30 from its safe, or out-of-line position, to its fully armed, or aligned position. Slider 30 is driven with sufficient force to shear off safety boss 36 which allows alignment of slider 30. Frictional forces between piston 40 and piston actuator 32 provide a locking resistance to secure slider 30 in its armed, or in line, position.

Fuzing subsystem 87 then produces a firing signal that is supplied to the base of transistor 98. Bridgewire 94 then explodes when transistor 98 becomes conductive to cause detonator 44 to fire and ignite the firing train 57 which leads to the eventing of the warhead 65 of mine 12. Each lead, in the preferred embodiment, contains suitable pyrotechnic materials.

The align at fire capability of this invention allows the firing train of a land mine, for example, to become explosively aligned only milliseconds before the firing signal is produced to event mine 12. Aligning the firing train immediately prior to eventing the warhead is very desirable particularly for hand emplaced or recoverable mines.

The use of an align at fire safing and arming subsystem allows the safe recovery of a mine that has self-neutralized. Typically it is desirable; that a land mine be neutralized; i.e., put in a condition where the warhead can not event by action of the fuzing and safing and arming subsystems because certain predetermined conditions have occurred such as the passage of a predetermined period of time. Alternatively a mine may self-neutralize because the power supply has reached the end of its useful life as indicated by a drop in the output voltage of reserve batteries 16 below a predetermined level.

Mine 12 becomes self-neutralized when detonator 44 is fired prior to the firing of piston actuator 32, or while firing train 57 is interrupted. Slider 30 is restrained in its out-of-line position by safety boss 36 which precludes firing train continuity. In the self-neutralization mode, control circuit 88 of fuzing subsystem 87 produces only a fire signal which is supplied to the base of transistor 98. This causes a relative large current to flow through bridgewire 94, causing bridgewire 94 to explode, to initiate detonator 44. Detonation of detonator 44 then initiates stab primer 74 via explosive lead 76. Explosion of stab primer 74 causes bolt 78 to fracture along its fracture line which is determined by stress concentrating contour 86. Fracture of bolt 78 allows cover piece 80 and flag 84 to become unrestrained. Helical coil 82 is then free to expand and raises cover piece 80 and flag 84 to a height of about one foot above their compressed position. Flag 84 is then displayed to provide a visual indicator that mine 12 is safe.

When flag 84 of visual safe indicator 18 is displayed, it provides irrefutable evidence that mine 12 is safe so that recovery personnel can be assured when they see flag 84 that the explosive train 57 of the mine 12 has been permanently aborted. Flag 84 of visual safe indicator 18 also assists in locating a mine that has self-neutralized.

All openings of module 10 and the connections between the module 10 and the mine 12, are made weather proof, as is well known in the art, so that mine 12 and its module 10 will not be adversely affected by the environment in which they are placed. Module 10 not only provides the capability that the mine 12 with which it is associated can be recovered, it also permits a mine that is recovered to be rapidly refurbished. Refurbishing will normally only require the replacement of the align at fire, safe and arm, and power supply module 10. Thus, the more expensive portions of a land mine, particularly the warhead and its fuzing subsystem, are refurbishable and reusable. The use of a replaceable align at fire, safe and arm, and power supply module also makes it possible for the first time to provide a recoverable electronically fuzed mine.

While the principles of the invention have now been made clear in the illustrated embodiments, there will be immediately obvious to those skilled in the art, many modifications of structure, arrangements, proportions, elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What is claimed is:

1. A recoverable and refurbishable land mine 12 comprising:

a mine housing 20;

a warhead 65 located in said mine housing;

electronic fuzing means 87 located in the mine housing 20 for producing under one set of predetermined conditions an align signal and shortly thereafter a fire signal and under another set of predetermined conditions a fire signal;

an align at fire, safe and arm, and power supply module 10, said module including detonator means 44, said detonator means 44 being initiated responsive to a fire signal produced by the fuzing means 87 being applied thereto; means forming a firing train 57, said means forming a firing train 57 having an interrupted state and an aligned state, said means forming a firing train 57 initially being in its interrupted state; actuator means 32 responsive to an align signal produced by the fuzing means 87 for causing the means forming a firing train 57 to change from its interrupted state to its aligned state; said means forming a firing train 57 in its aligned state establishing a continuous lead from the detonator means 44 to the mine warhead 65 when the module 10 is mounted into the mine 12 for eventing the warhead 65 in response to the fuzing means 87 producing a fire signal; the application of a fire signal to detonator means 44 while the means forming a firing train 57 is in its interrupted state neutralizing the warhead 44; and battery means 16 for producing electrical power;

means for removably mounting 22, 24 the module 10 into the mine 12; and means for providing electrical connections 100 between the battery means 16 and the fuzing means 87 and between the fuzing means 87 and the detonator means 44 and actuator means 32.

2. A recoverable and refurbishable land mine 12 as defined in claim 1 in which the battery means 16 includes a pair of reserve batteries.

3. A recoverable and refurbishable land mine 12 as defined in claim 2 in which the means for removably mounting 22, 24 the module 10 into mine 12 includes a pair of cooperating fittings 22, 24.

4. A recoverable and refurbishable land mine 12 as defined in claim 3 in which the module 10 further includes a removable safety pin means 25 for maintaining the means forming a firing train 57 in its interrupted state until removed.

5. A recoverable and refurbishable land mine 12 as defined in claim 4 in which removal of the safety pin means 25 initiates energization of the reserve batteries 16.

6. A recoverable and refurbishable land mine 12 as defined in claim 5 in which the module 10 further includes visual safe indicator means 18 for providing a visual display identifying the location of the mine 12 when the warhead 65 is neutralized by the detonation of detonator means 44 by a fire signal produced by the fuzing means 87 while firing train 57 is in its interrupted state.

7. A replaceable align at fire, safe and arm, and power supply (AFSAP) module 10 for a land mine 12 said land mine 12 having an explosive warhead 65 having an inlet lead 64, electronic fuzing means 87 for producing an align signal and a fire signal, and means for mounting 24 the module 10 in said land mine 12, said module 10 comprising:

a module housing 14;

mounting means 22 on said module housing 14 for removably mounting the module 14 in the land mine 12 in cooperation with the mine's means for mounting 24;

a slider 30 slidably mounted within said module housing 14, said slider 30 having a transfer lead 60, said slider 30 having two positions, a safe position and an armed position;

actuator means 32 mounted in the module housing 14 for moving the slider 30 from its safe position to its armed position responsive to an align signal being produced by the fuzing means 87 and being applied to the actuator means 32;

detonator means 44 mounted in the module housing 14, said detonator means 44 being initiated responsive to a fire signal being produced by the fuzing means 87 and being applied to the detonator means 44;

means forming a firing train 57, said means forming a firing train 57 including an outlet lead 56 in the module housing 14 the inlet lead 64 of the warhead 65 when the module 10 is mounted on the mine 12, the transfer lead 60 of the slider 30, and the detonator means 44, said means forming a firing train 57 being aligned when said slider 30 is in its armed position so that initiating the detonator means 44 events the warhead 65; said means forming a firing train 57 being interrupted when said slider 30 is in its safe position so that initiating the detonator means 44 self-neutralizes the mine;

detention means 36 for retaining the slider in its safe position until the actuator means 32 moves the slider 30 to its armed position;

battery means 16 mounted in the housing 14 for providing electrical power to the fuzing means 87 of the mine 12; and electrical connector means 100 for establishing electrical circuits between the battery means 16 of the module 10 the fuzing means 87 of the mine 12, and between the fuzing means 87 of the mine 12 and the actuator 32 and to the detonator 44.

8. A replaceable AFSAP module 10 for a land mine 12, as defined in claim 7, in which the battery means 16 includes a pair of reserve batteries.

9. A replaceable AFSAP module 10 as defined in claim 7 in which the mounting means includes a pair of cooperating fittings 22, 24, one 24 on the land mine 12 and one 22 on the module 10.

10. A replaceable AFSAP module 10 as defined in claim 9 in which the electrical connector means 100 forms complete electrical circuits when the module fitting 22 is mounted on the cooperating fitting 24 of the mine 12.

11. A replaceable AFSAP module 10 in which the module 10 further includes removable safety pin means 25, said safety pin means 25 for preventing the slider 30 from moving from its safe position to its armed position.

12. A replaceable AFSAP module 10 as defined in claim 11 in which the removal of the safety pin means 25 initiates the energization of the reserve batteries 16.

13. A replaceable AFSAP module 10 as defined in claim 12 in which module 10 further includes a visual safe indicator means 18 mounted on module housing 14 for presenting a visual display 84 identifying the location of the module 10 and the mine 12 on which the module is mounted when the mine self-neutralizes.

14. An align at fire safe and arm and power supply (AFSAP) module 10 for mounting into a land mine 12 having a warhead 65, an input lead 64 for the warhead 65, electronic fuzing means 87 for producing an align signal and a fire signal, and mine mounting means 24 for removably mounting the AFSAP module 10 into a land mine 12, comprising:

a module housing 14;

a slider 30 slidably mounted within said module housing 14, said slider 30 having two positions, a safe position and an armed position, said slider 30 having first means forming a transfer lead 60 through said slider 30, said transfer lead 60 having a first inlet 58 and a first outlet 62;

piston actuator means 32 mounted in the module housing 14 for moving the slider 30 from its safe position to its armed position when initiated by an align signal produced by the fuzing means 87;

a detonator 44 mounted in the housing 14 and positioned so that the detonator 44, is in communication with the first inlet 58 of the transfer lead 60 only when the slider 30 is in its armed position, said detonator 44 being initiated by a fire signal produced by the fuzing means;

module mounting means 22 on said module housing 14 for removably mounting the module 10 into the land mine 12 in cooperation with the mine mounting means 24, said module mounting means 22 including means forming an outlet lead 56, said outlet lead 56 being aligned with and in communication with the first outlet 62 of the transfer lead 60 only when slider 30 is in its armed position, the outlet lead 56 being in communication with the input lead 64 of the warhead 65 when the module 10 is mounted in the mine 12, whereby initiating detonator 44 when slider 30 is in its armed position events the warhead 65 of mine 12;

visual safe indicator means 18 mounted on said housing 14 said visual safe indicator means 18 being displayed when the detonator 44 is initiated;

reserve battery means 16 mounted in module housing 14 for producing electrical power when energized;

electrical connector means 100 for electrically connecting reserve battery means 16 to electronic fuzing means 87 of mine 12 and fuzing means 87 to the piston actuator means 32, and the detonator 44;

removable safety means 25 positioned in the housing 14 for inhibiting energization of the reserve battery means 16 and for holding the slider 30 in its safe position; removal of the removable safety means 25 energizing the reserve battery means 16 and enabling the piston actuator means 32 to move slider 30 to its armed position; and means for holding 36, 54 slider 30 in its safe position after the safety means 25 is removed from the housing 14 until piston actuator means 32 is initiated by an align signal, said visual display means 18 being displayed when the fuzing means 87 produces a fire signal prior to an align signal.

15. An AFSAP module 10 as defined in claim 14 in which the reserve battery means 16 includes a pair of reserve batteries.

16. An AFSAP module 10 as defined in claim 15 in which mounting the module 10 on the mine's mounting means 24 completes the electrical connections 100 between the battery means 16, the fuzing means 87, the piston actuator means 32 and the detonator 44.

17. An AFSAP module 10 as defined in claim 16 in which the removable safety means 25 is a safety pin.

18. An AFSAP module 10 as defined in claim 17 in which the means for holding slider 30 in its safe position is a recess 54 formed in slider 30 into which projects safety boss 36 formed on housing 14.

19. An AFSAP module 10 as defined in claim 18 in which the visual safe indicator means 18 includes a compressed helical spring 82 held in its compressed state by an explosive bolt 78 which is detonated by initiating the detonator 44.

* * * * *